US009520031B2

(12) United States Patent
Brito

(10) Patent No.: US 9,520,031 B2
(45) Date of Patent: Dec. 13, 2016

(54) SLOT MACHINE GAME WITH SYMBOL LOCK-IN

(75) Inventor: Melisa Brito, Buenos Aires (AR)

(73) Assignee: Etasse Limited, Alderney (GB)

( * ) Notice: Subject to any disclaimer, the term of this patent is extended or adjusted under 35 U.S.C. 154(b) by 554 days.

(21) Appl. No.: 12/168,878

(22) Filed: Jul. 7, 2008

(65) Prior Publication Data

US 2010/0004048 A1 Jan. 7, 2010

(51) Int. Cl.
*G07F 17/32* (2006.01)

(52) U.S. Cl.
CPC ..... *G07F 17/3265* (2013.01)

(58) Field of Classification Search
CPC ..... G07F 17/3265
USPC ..... 463/20
See application file for complete search history.

(56) References Cited

U.S. PATENT DOCUMENTS

| | | | |
|---|---|---|---|
| 4,836,546 | A | 6/1989 | DiRe et al. |
| 4,844,476 | A | 7/1989 | Becker |
| 5,033,744 | A | 7/1991 | Bridgeman et al. |
| 5,342,049 | A | 8/1994 | Wichinsky et al. |
| 5,401,023 | A | 3/1995 | Wood |
| 5,401,024 | A | 3/1995 | Simunek |
| 5,411,271 | A | 5/1995 | Mirando |
| 5,456,465 | A | 10/1995 | Durham |
| 5,511,781 | A | 4/1996 | Wood et al. |
| 5,676,371 | A | 10/1997 | Kelly et al. |
| 5,704,835 | A | 1/1998 | Dietz, II |
| 5,720,662 | A | 2/1998 | Holmes et al. |
| 5,769,716 | A | 6/1998 | Saffari et al. |
| 5,823,874 | A | 10/1998 | Adams |
| 5,833,537 | A | 11/1998 | Barrie |
| 5,947,821 | A | 9/1999 | Stone |
| 5,976,016 | A | 11/1999 | Moody et al. |
| 6,001,016 | A | 12/1999 | Walker et al. |
| 6,015,346 | A | 1/2000 | Bennett |
| 6,059,659 | A | 5/2000 | Busch et al. |
| 6,070,874 | A | 6/2000 | Ivers |

(Continued)

FOREIGN PATENT DOCUMENTS

| | | |
|---|---|---|
| EP | 1063622 | 12/2000 |
| EP | 1652562 | 5/2006 |

(Continued)

OTHER PUBLICATIONS

Sony Pictures Television—Wheel of Fortune 20th Anniversary—downloaded from http://webarchive.org/web/20030624010929/http://www.wheeloffortune.com/, Jun. 24, 2003.

(Continued)

*Primary Examiner* — James S McClellan
*Assistant Examiner* — Syvila Weatherford
(74) *Attorney, Agent, or Firm* — McDonnell Boehnen Hulbert & Berghoff LLP

(57) ABSTRACT

A slot machine game that allows a player to lock in particular symbol(s) after playing a game. If the player prefers one or more particular symbols to remain in position after a spin, the player can indicate to the slot machine the desire to lock in the particular symbols, wherein the player will have to pay a price for the ability to have those symbols locked in for a next spin. Then, the player places another wager and spins the reels while the particular symbols remain unchanged.

22 Claims, 7 Drawing Sheets

(56) References Cited

U.S. PATENT DOCUMENTS 6,120,298 A 9/2000 Jenkins et al.
6,129,632 A 10/2000 Luciano
6,159,097 A 12/2000 Gura
6,174,235 B1 1/2001 Walker et al.
6,186,894 B1 2/2001 Mayeroff
6,193,606 B1 2/2001 Walker et al.
6,210,275 B1 4/2001 Olsen
6,224,483 B1 5/2001 Mayeroff
6,270,409 B1 8/2001 Shuster
6,287,197 B1 9/2001 Dickinson et al.
6,338,678 B1 1/2002 Seelig et al.
6,346,043 B1 2/2002 Colin et al.
6,347,996 B1 2/2002 Gilmore et al.
6,358,147 B1 3/2002 Jaffe et al.
6,390,473 B1 5/2002 Vancura et al.
6,394,899 B1 5/2002 Walker
6,413,161 B1 7/2002 Baerlocher et al.
6,425,824 B1 7/2002 Baerlocher et al.
6,450,888 B1 9/2002 Takase et al.
6,485,367 B1 11/2002 Joshi
6,547,242 B1 4/2003 Sugiyama et al.
6,554,283 B2 4/2003 Vancura et al.
6,575,831 B1 6/2003 Gonen et al.
6,595,854 B2 7/2003 Hughs-Baird et al.
6,601,850 B1 8/2003 Ross
6,604,740 B1 8/2003 Singer et al.
6,609,971 B2 8/2003 Vancura
6,609,974 B2 8/2003 Mead et al.
6,641,477 B1 11/2003 Dietz et al.
6,663,489 B2 12/2003 Baerlocher et al.
6,666,765 B2 12/2003 Vancura
6,669,559 B1 12/2003 Baerlocher et al.
6,695,696 B1 2/2004 Kaminkow
6,709,332 B2 3/2004 Adams
6,731,313 B1 5/2004 Kaminkow
6,752,396 B2 6/2004 Smith
6,761,632 B2 7/2004 Bansemer et al.
6,769,986 B2 8/2004 Vancura
6,780,103 B2 8/2004 Bansemer et al.
6,780,107 B2 8/2004 Baerlocher et al.
6,811,486 B1 11/2004 Luciano, Jr.
6,830,514 B2 12/2004 Meyer et al.
6,855,054 B2 2/2005 White et al.
6,860,810 B2 3/2005 Cannon et al.
6,863,606 B1 3/2005 Berg et al.
6,869,360 B2 3/2005 Marks et al.
6,884,165 B2 4/2005 Baerlocher
6,890,257 B2 5/2005 Baerlocher
6,896,260 B2 5/2005 Pierce
6,902,481 B2 6/2005 Breckner et al.
6,938,068 B1 8/2005 Kraft et al.
6,939,223 B1 9/2005 Jones
6,942,568 B2 9/2005 Baerlocher
6,942,571 B1 9/2005 McAllister et al.
6,950,993 B2 9/2005 Breinberg
6,964,416 B2 11/2005 McClintic et al.
6,966,836 B1 11/2005 Rush et al.
6,984,174 B2 1/2006 Cannon et al.
6,991,539 B2 1/2006 Pacey
6,997,805 B2 2/2006 Vancura
7,036,083 B1 4/2006 Zenith
7,056,210 B2 6/2006 Bansemer et al.
7,066,811 B1 6/2006 DeFrees-Parrot et al.
7,147,559 B2 12/2006 Englman
7,175,524 B2 2/2007 Bansemer et al.
7,175,527 B2 2/2007 Bryant
7,192,346 B2 3/2007 Mathis
7,252,589 B1 8/2007 Marks et al.
7,264,545 B2 9/2007 Maya et al.
7,275,989 B2 10/2007 Moody
7,326,115 B2 2/2008 Baerlocher
7,341,513 B2 3/2008 Cuddy et al.
7,364,506 B2 4/2008 Jaffe et al.
7,367,883 B2 5/2008 Gagnon
7,371,173 B2 5/2008 Gatto et al.
7,377,850 B2 5/2008 Shackelford et al.
7,393,278 B2 7/2008 Gerson et al.
7,470,193 B2 12/2008 Umezaki
7,534,168 B2 5/2009 Bennett et al.
7,559,836 B2 7/2009 Gerson et al.
7,585,219 B2 9/2009 Randall et al.
7,631,872 B2 12/2009 Roemer et al.
7,690,996 B2 4/2010 Iddings et al.
7,713,123 B2 5/2010 Gerson et al.
7,727,063 B2 6/2010 Walker et al.
7,753,790 B2 7/2010 Nguyen et al.
7,771,279 B2 8/2010 Miyamoto et al.
7,789,749 B2 9/2010 Bansemer et al.
7,819,748 B2 10/2010 Ajioka
7,846,015 B2 12/2010 Bansemer et al.
8,231,453 B2 7/2012 Wolf et al.
8,371,919 B2 2/2013 Hornik et al.
8,475,262 B2 7/2013 Wolf et al.
2001/0003709 A1 6/2001 Adams
2001/0009865 A1 7/2001 Demar et al.
2001/0031659 A1 10/2001 Perrie et al.
2002/0010017 A1 1/2002 Bennett
2002/0027323 A1 3/2002 Vancura et al.
2002/0043759 A1 4/2002 Vancura
2002/0045474 A1 4/2002 Singer et al.
2002/0049082 A1 4/2002 Bansemer et al.
2002/0052234 A1 5/2002 Adams
2002/0058545 A1* 5/2002 Luciano ..... 463/18
2002/0077165 A1 6/2002 Bansemer et al.
2002/0198044 A1* 12/2002 Walker et al. ..... 463/25
2003/0003980 A1 1/2003 Moody
2003/0013514 A1 1/2003 Cregan et al.
2003/0022711 A1 1/2003 Locke et al.
2003/0027619 A1 2/2003 Nicastro
2003/0027639 A1 2/2003 Peterson et al.
2003/0036423 A1 2/2003 Vancura
2003/0040355 A1 2/2003 Baerlocher
2003/0060276 A1 3/2003 Walker et al.
2003/0060278 A1 3/2003 Walker et al.
2003/0060281 A1 3/2003 Vancura
2003/0064782 A1 4/2003 Beaulieu et al.
2003/0064797 A1 4/2003 Jackson et al.
2003/0064800 A1 4/2003 Jackson et al.
2003/0092476 A1 5/2003 Fox
2003/0092480 A1 5/2003 White et al.
2003/0100361 A1 5/2003 Sharpless et al.
2003/0119576 A1 6/2003 McClintic et al.
2003/0119581 A1 6/2003 Cannon et al.
2003/0125107 A1 7/2003 Cannon
2003/0130027 A1 7/2003 Aida
2003/0153375 A1 8/2003 Vancura
2003/0162584 A1 8/2003 Hughs-Baird et al.
2003/0162585 A1 8/2003 Bigelow, Jr. et al.
2003/0181231 A1 9/2003 Vancura et al.
2003/0186733 A1 10/2003 Wolf et al.
2003/0195027 A1 10/2003 Baerlocher et al.
2003/0195034 A1 10/2003 Dunaevsky
2003/0216165 A1 11/2003 Singer et al.
2003/0224849 A1 12/2003 Geiger
2004/0014517 A1 1/2004 Inoue
2004/0023715 A1 2/2004 Luciano, Jr.
2004/0036216 A1 2/2004 Vancura
2004/0048650 A1 3/2004 Mierau et al.
2004/0053657 A1 3/2004 Fiden et al.
2004/0053683 A1 3/2004 Hartl et al.
2004/0063483 A1 4/2004 Wolf et al.
2004/0072603 A1 4/2004 Shuster
2004/0072607 A1 4/2004 Thomas et al.
2004/0092300 A1* 5/2004 Gauselmann ..... 463/16
2004/0116173 A1 6/2004 Baerlocher
2004/0121838 A1 6/2004 Hughs-Baird et al.
2004/0127280 A1 7/2004 Moody
2004/0152509 A1 8/2004 Hornik et al.
2004/0176157 A1 9/2004 Walker et al.
2004/0198490 A1 10/2004 Bansemer et al.
2004/0204233 A1 10/2004 Saffari et al.
2004/0209662 A1 10/2004 Wadleigh
2004/0219969 A1 11/2004 Casey et al.
2004/0235548 A1 11/2004 Benbrahim

(56) References Cited

U.S. PATENT DOCUMENTS

| | | | | |
|---|---|---|---|---|
| 2004/0235556 | A1 | 11/2004 | Flemming et al. | |
| 2004/0242316 | A1 | 12/2004 | Oles et al. | |
| 2005/0014551 | A1 | 1/2005 | Packes et al. | |
| 2005/0014557 | A1 | 1/2005 | Duhamel | |
| 2005/0014563 | A1 | 1/2005 | Barri | |
| 2005/0026664 | A1 | 2/2005 | Bansemer et al. | |
| 2005/0026679 | A1 | 2/2005 | Lucchesi et al. | |
| 2005/0032566 | A1 | 2/2005 | Baerlocher et al. | |
| 2005/0033711 | A1 | 2/2005 | Horvitz et al. | |
| 2005/0054416 | A1 | 3/2005 | Hostetler et al. | |
| 2005/0054430 | A1 | 3/2005 | Pitman et al. | |
| 2005/0085285 | A1 | 4/2005 | Muskin | |
| 2005/0090307 | A1 | 4/2005 | Walker et al. | |
| 2005/0107154 | A1* | 5/2005 | Pacey | 463/20 |
| 2005/0119040 | A1 | 6/2005 | Berman et al. | |
| 2005/0130737 | A1 | 6/2005 | Englman et al. | |
| 2005/0137007 | A1 | 6/2005 | Schaufelberger | |
| 2005/0153765 | A1 | 7/2005 | Shoostine | |
| 2005/0153770 | A1 | 7/2005 | Vancura | |
| 2005/0164794 | A1 | 7/2005 | Tahara | |
| 2005/0176494 | A1 | 8/2005 | Thomas | |
| 2005/0181866 | A1 | 8/2005 | Baerlocher | |
| 2005/0187005 | A1 | 8/2005 | Rose | |
| 2005/0187023 | A1 | 8/2005 | Miyamoto et al. | |
| 2005/0202864 | A1 | 9/2005 | Duhamel et al. | |
| 2005/0202869 | A1 | 9/2005 | Miyamoto et al. | |
| 2005/0215311 | A1 | 9/2005 | Hornik et al. | |
| 2005/0266916 | A1 | 12/2005 | Sato et al. | |
| 2005/0277469 | A1 | 12/2005 | Pryzby et al. | |
| 2006/0003831 | A1 | 1/2006 | Falciglia | |
| 2006/0019738 | A1 | 1/2006 | Baerlocher et al. | |
| 2006/0025196 | A1 | 2/2006 | Webb et al. | |
| 2006/0030398 | A1 | 2/2006 | Hornik | |
| 2006/0046818 | A1 | 3/2006 | Goins | |
| 2006/0046853 | A1 | 3/2006 | Black | |
| 2006/0063584 | A1 | 3/2006 | Brill et al. | |
| 2006/0073863 | A1 | 4/2006 | Hagiwara | |
| 2006/0073878 | A1 | 4/2006 | Shackelford et al. | |
| 2006/0121972 | A1 | 6/2006 | Walker et al. | |
| 2006/0121978 | A1 | 6/2006 | Hornick et al. | |
| 2006/0160595 | A1* | 7/2006 | Gerson et al. | 463/16 |
| 2006/0160614 | A1 | 7/2006 | Walker et al. | |
| 2006/0172791 | A1 | 8/2006 | Wolf | |
| 2006/0181028 | A1 | 8/2006 | Benator | |
| 2006/0183536 | A1 | 8/2006 | Gagner et al. | |
| 2006/0189377 | A1 | 8/2006 | Gomez et al. | |
| 2006/0189378 | A1 | 8/2006 | Aoki | |
| 2006/0205483 | A1 | 9/2006 | Meyer et al. | |
| 2006/0240890 | A1 | 10/2006 | Walker et al. | |
| 2006/0247035 | A1 | 11/2006 | Rowe et al. | |
| 2006/0252494 | A1 | 11/2006 | Gerson et al. | |
| 2006/0252495 | A1 | 11/2006 | Gerson et al. | |
| 2006/0264255 | A1 | 11/2006 | Borissov | |
| 2007/0060254 | A1 | 3/2007 | Muir | |
| 2007/0060314 | A1 | 3/2007 | Baerlocher et al. | |
| 2007/0077988 | A1 | 4/2007 | Friedman | |
| 2007/0087805 | A1 | 4/2007 | Taylor | |
| 2007/0102877 | A1 | 5/2007 | Personius et al. | |
| 2007/0161424 | A1* | 7/2007 | Gatto et al. | 463/20 |
| 2007/0167217 | A1 | 7/2007 | Kaminkow et al. | |
| 2007/0171192 | A1 | 7/2007 | Seo et al. | |
| 2007/0190495 | A1 | 8/2007 | Kendir et al. | |
| 2007/0281774 | A1 | 12/2007 | Khai | |
| 2007/0287523 | A1 | 12/2007 | Esses et al. | |
| 2008/0045295 | A1 | 2/2008 | Walker et al. | |
| 2008/0076513 | A1 | 3/2008 | Esses et al. | |
| 2008/0076518 | A1 | 3/2008 | Yoshizawa | |
| 2008/0102923 | A1 | 5/2008 | Esses et al. | |
| 2008/0113769 | A1 | 5/2008 | Montero et al. | |
| 2008/0119260 | A1 | 5/2008 | Nores | |
| 2008/0119261 | A1 | 5/2008 | Heymann | |
| 2008/0153570 | A1 | 6/2008 | Esses et al. | |
| 2008/0167116 | A1 | 7/2008 | Gerson | |
| 2008/0214292 | A1 | 9/2008 | Bryant et al. | |
| 2008/0234032 | A1* | 9/2008 | Brunet de Courssou et al. | 463/20 |
| 2008/0274798 | A1 | 11/2008 | Walker et al. | |
| 2008/0310302 | A1 | 12/2008 | Detwiler et al. | |
| 2008/0318660 | A1 | 12/2008 | Nores | |
| 2009/0005145 | A1* | 1/2009 | White | 463/16 |
| 2009/0029773 | A1 | 1/2009 | Cherry | |
| 2009/0029779 | A1 | 1/2009 | Murase et al. | |
| 2009/0061982 | A1 | 3/2009 | Brito | |
| 2009/0064000 | A1 | 3/2009 | Garbow et al. | |
| 2009/0082080 | A1* | 3/2009 | Bennett et al. | 463/16 |
| 2009/0093296 | A1 | 4/2009 | Gerson et al. | |
| 2009/0104977 | A1 | 4/2009 | Zielinski | |
| 2009/0124328 | A1 | 5/2009 | Nores | |
| 2009/0124352 | A1 | 5/2009 | Gerson | |
| 2009/0233692 | A1* | 9/2009 | Yoshizawa | 463/20 |
| 2009/0239631 | A1* | 9/2009 | Aoki et al. | 463/20 |
| 2009/0286586 | A1 | 11/2009 | Heymann et al. | |
| 2010/0004048 | A1 | 1/2010 | Brito | |
| 2010/0029376 | A1 | 2/2010 | Hardy et al. | |
| 2010/0029378 | A1 | 2/2010 | Gerson et al. | |
| 2010/0048284 | A1* | 2/2010 | Jaffe | 463/20 |
| 2010/0210356 | A1 | 8/2010 | Losica | |
| 2010/0240456 | A1 | 9/2010 | Goto et al. | |
| 2010/0317424 | A1 | 12/2010 | Hornik et al. | |
| 2010/0331071 | A1 | 12/2010 | Uchiyama et al. | |
| 2011/0281627 | A1 | 11/2011 | Lutnick et al. | |
| 2012/0052939 | A1 | 3/2012 | Lutnick et al. | |

FOREIGN PATENT DOCUMENTS

| | | | |
|---|---|---|---|
| GB | 2148037 | | 5/1985 |
| GB | 2335524 | | 9/1999 |
| WO | 2006076462 | A3 | 7/2006 |
| WO | 2007076514 | A3 | 7/2007 |
| WO | 2007143704 | A3 | 12/2007 |
| WO | 2008039413 | A3 | 4/2008 |
| WO | 2008051518 | A3 | 5/2008 |
| WO | 2008057188 | | 5/2008 |
| WO | 2008057201 | A3 | 5/2008 |
| WO | 2008060472 | A3 | 5/2008 |
| WO | 2008060473 | A3 | 5/2008 |
| WO | 2009032130 | A3 | 3/2009 |

OTHER PUBLICATIONS

Instructions for "Clue Classsic Detective Game," Hasbro, Inc. copyright 1986, available at http://www.hasbro.com/common/instruct/clueins.pdf, last accessed on Jun. 24, 2013, 4 pages.

European Patent Office, Supplementary European Search Report for European Application No. EP 06 71 8145, Apr. 30, 2010.

Illinois Lottery Office of the Superintendent Game Rules, Downloaded from the World Wide Web at http://webarchive.org/web/w0061109031843/http://www.illinoislottery.com/subsections/OnLineRules.htm, downloaded on Sep. 28, 2011 as archived on Nov. 9, 2006.

International Search Report, PCT/US2007/023658, Sep. 22, 2008.

International Search Report and Written Opinion, PCT/US2007/022775 (counterpart to U.S. Appl. No. 11/776,508), Aug. 15, 2008.

International Searching Authority/U.S. Patent Office, International Search Report for PCT/U808/10156, Jun. 25, 2009.

International Searching Authority/U.S. Patent Office, Written Opinion of the International Searching Authority for International Application No. PCT/US07/22425, Jul. 24, 2008.

International Searching Authority/U.S. Patent Office, Written Opinion of the International Searching Authority (revised) for International Application No. PCT/US07/23656, Aug. 25, 2008.

International Searching Authority/U.S. Patent Office, Written Opinion of the International Searching Authority for International Application No. PCT/US07/23658, Sep. 22, 2008.

Lim, Seno Heno, USPTO Office Action dated Jun. 9, 2008.

"Nintendogs" instuction booklet by Nintendo of Amerca, Inc., http://nintendo.com/consumer/gameslist/manuals/DS_Nintendogs.pdf, Jul. 15, 2005.

(56) References Cited

OTHER PUBLICATIONS

PCT Search Report and Opinion, PCT/US2007/022425, Jul. 24, 2008.
PCT/US2006/062630, PCT Search Report and Opinion, Mar. 17, 2008.
PCT/US2007/023656 Search Report and Opinion, Aug. 25, 2008.
PCT/US2007/070550, International Search Report, Sep. 16, 2008.
PCT/US2007/074030, Search Report and Opinion, Sep. 26, 2008.
PCT/US2008/010156, International Search Report, Jun. 25, 2009.
The International Bureau of WIPO, International Preliminary Report on Patentability and Written Opinion of the International Searching Authority for International Application PCT/US2006/000346, Jun. 15, 2006.
The International Bureau of WIPO, International Preliminary Report on Patentability and Written Opinion of the International Searching Authority for International Application PCT/US2006/001034, Nov. 7, 2007.
The International Bureau of WIPO, International Preliminary Report on Patentability and Written Opinion of the International Searching Authority for International Application PCT/US2006/062630, Mar. 17, 2008.
The International Bureau of WIPO, International Preliminary Report on Patentability and Written Opinion of the International Searching Authority for International Application PCT/US2007/20589, Apr. 1, 2008.
The Internatonal Bureau of WIPO, International Preliminary Report on Patentability and Written Opinion of the International Searching Authority for International Application PCT/US2007/022425, Jul. 24, 2008.
The International Bureau of WIPO, International Preliminary Report on Patentability and Written Opinion of the International Searching Authority for International Application PCT/US2007/022426, May 21, 2008.
The International Bureau of WIPO, International Preliminary Report on Patentability and Written Opinion of the International Searching Authority for International Application PCT/US2007/022775, Aug. 15, 2008.
The International Bureau of WIPO, International Preliminary Report on Patentability and Written Opinion of the International Searching Authority for International Application PCT/US2007/023657, Sep. 29, 2008.
The International Bureau of WIPO, International Preliminary Report on Patentability and Written Opinion of the International Searching Authority for International Application PCT/US2007/023658, Sep. 22, 2008.
Translated Office Action in Macau Economy Bureau, application No. 1/0004388(880), Apr. 17, 2009.
Wikipedia, "Wheel of Fortune," http://en.wikipedia.org/wiki/Wheel_of_Fortune, printed Dec. 8, 2008.
World Intellectual Property Organization—International Bureau, International Search Report for International Application No. PCT/US06/01034, Nov. 7, 2007.
World Intellectual Property Organization—International Bureau, International Search Report for International Application No. PCT/US06/62630, Mar. 17, 2008.
World Intellectual Property Organization—International Bureau, International Search Report for International Application No. PCT/US07/022425, Jul. 24, 2008.
World Intellectual Property Organization—International Bureau, International Search Report for International Application No. PCT/US07/022426, May 28, 2008.
World Intellectual Property Organization—International Bureau, International Search Report for International Application No. PCT/US07/20589, Apr. 1, 2008.
World Intellectual Property Organization—International Bureau, International Search Report for International Application No. PCT/US07/23657, Sep. 29, 2008.
PCT/US06/01034—WO/2006/076462 (counterpart PCT application), International Search Report, Written Opinion of the International Search Authority, Nov. 7, 2007.
U.S. Appl. No. 11/326,125, filed Jan. 3, 2006.
U.S. Appl. No. 11/337,960, filed Jan. 23, 2006.
U.S. Appl. No. 11/558,405, filed Nov. 9, 2006.
U.S. Appl. No. 11/609,315, filed Dec. 11, 2006.
U.S. Appl. No. 11/678,050, filed Feb. 22, 2007.
U.S. Appl. No. 11/764,689, filed Jun. 18, 2007.
U.S. Appl. No. 11/776,508, filed Jul. 11, 2007.
U.S. Appl. No. 11/781,941, filed Jul. 23, 2007.
U.S. Appl. No. 11/846,239, filed Aug. 28, 2007.
U.S. Appl. No. 11/860,524, filed Sep. 24, 2007.
U.S. Appl. No. 11/873,740, filed Oct. 17, 2007.
U.S. Appl. No. 11/874,409, filed Oct. 18, 2007.
U.S. Appl. No. 11/928,413, filed Oct. 30, 2007.
U.S. Appl. No. 11/949,749, filed Dec. 3, 2007.
U.S. Appl. No. 11/952,470, filed Dec. 7, 2007.
U.S. Appl. No. 12/107,255, filed Apr. 22, 2008.
U.S. Appl. No. 12/122,110, filed May 16, 2008.
U.S. Appl. No. 12/165,335, filed Jun. 30, 2008.
U.S. Appl. No. 12/773,847.
U.S. Appl. No. 12/495,774, filed Jun. 30, 2009.

* cited by examiner

PRIOR ART

SLOT MACHINE GAME WITH SYMBOL LOCK-IN

CROSS REFERENCE TO RELATED APPLICATIONS

This application is related to the following applications identified by their application serial numbers: Ser. No. 11/035,691 ("Slot Machine Game that Allows Player to Purchase Reel Respins"); Ser. No. 11/326,125 ("Slot Machine Bonus Game); Ser. No. 11/337,960 ("Slot Machine with Skill Aspect"); Ser. No. 11/609,315 ("System and Method for Allowing Piggyback Wagering"); Ser. No. 11/459,253 ("Slot Machine Bonus Game"); Ser. No. 11/558,564 ("System and Method for Administering a Progressive Jackpot Limited to a Bonus Round"); Ser. No. 11/678,050 ("Slot Machine Game With Additional Features"); Ser. No. 11/764,689 ("Slot Machine Game with Additional Award Indicator); Ser. No. 11/776,508 ("Slot Machine Game with User Selectable Themes"). All nine of these applications are incorporated by reference herein in their entireties for all purposes. Any and all features of any of these applications can be combined with each other and with any feature(s) described herein.

FIELD OF THE INVENTION

The present inventive concept relates to a slot machine game which allows a player to complete a slot machine game, then select one or more symbols to lock in at a cost to the player, and then play the slot machine game again with the selected symbols locked into place.

DESCRIPTION OF THE RELATED ART

FIG. 1 is a prior art drawing of a typical five reel slot machine symbol combination.

As known in the art, a slot machine can have five reels displaying three vertical symbols. A player places a wager (which is comprised of individual wagers placed on individual paylines), spins the reels (by pressing a button) which then stop at random positions, and then the slot machine computes a total win by comparing symbols on each payline bet on with a paytable. The player can then begin a new game by placing a new wager and spinning all of the reels.

Slot machine games are known which allow the player to effectuate respins. For example, see patent publication 2006/0160595 to Gerson et al., discloses a slot machine game wherein a player can purchase a reel respin for a particular purchase price based on the game situation.

What is needed is a game which allows a player to lock in particular symbol(s) and then play the game again.

SUMMARY OF THE INVENTION

It is an aspect of the present general inventive concept to provide an improved slot machine game.

The above aspects can be obtained by a method that includes (a) receiving an initial wager from a player; (b) determining symbols randomly to display a first result in a grid; (c) paying any earned award on the initial wager based on the first result; (d) receiving a selection of a particular lock in symbol from the first result; (e) receiving a second wager and a lock in price from the player; (f) determining symbols randomly but maintaining the particular lock in symbol to display a second result in the grid; and (g) paying any earned award on the second wager based on the second result.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
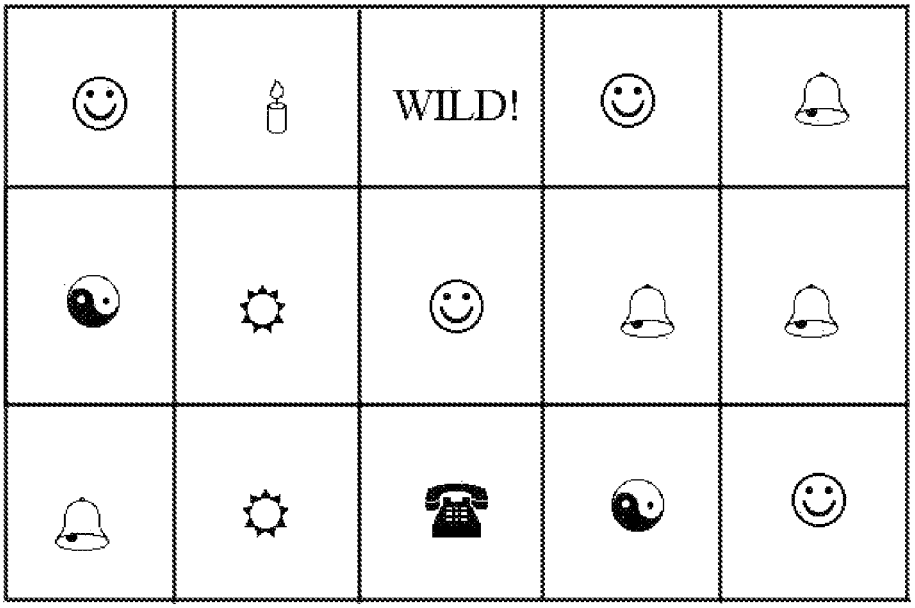
FIG. 1 is a prior art drawing of a typical five reel slot machine symbol combination.

Reference will now be made in detail to the presently preferred embodiments of the invention, examples of which are illustrated in the accompanying drawings, wherein like reference numerals refer to like elements throughout.

Embodiments of the invention relate to a slot machine game which can allow a player to play a slot machine game, and then lock in one or more symbol(s) selected by the player. The player can then play a new game with the locked in symbols remaining in their respective positions. The player will pay a computed surcharge (in addition to the player's wager) for the ability to lock in symbols. The surcharge will be based on the player's advantage in the particular symbol the player is locking in. The surcharge will be based on the particular location of the symbol, the symbol itself that will be locked in, the reel configurations, and the paytable being used.

Figure 2:
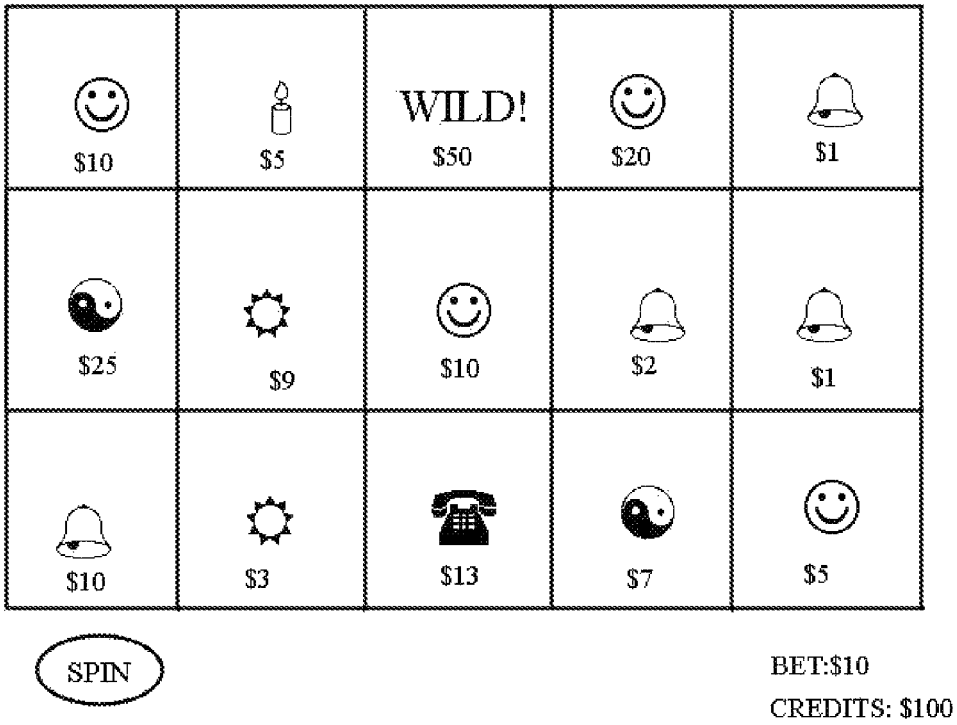
FIG. 2 is a drawing of the symbol combination illustrated in FIG. 1 with symbol lock prices, according to an embodiment.

FIG. 2 is a drawing of the symbol combination illustrated in FIG. 1 with symbol lock prices, according to an embodiment.

FIG. 2 can be displayed after the player plays a round of the slot game (for example as illustrated in FIG. 1). Shown is a grid of 15 symbol positions (although of course any dimensions can be used) and a symbol in each respective symbol position. Paylines can be formed, each payline having an individual wager on it. A payline can be any combination of five symbols (in this particular example), such as the top row, the middle row, the bottom row, a "v" shape (i.e., the smiley face, the sun, the phone, the bell, the bell), an upside down "v" shape (i.e., the bell, the sun, the wild, the bell, the smiley face). There can be theoretically 243 paylines of five symbols (comprising any position from each of the five columns).

The player now has the option to lock in any symbol in its respective position on the grid the player wishes. Each of the 15 symbols in its respective position has a particular "lock in" price (or surcharge) displayed below the respective symbol that the player will have to pay in order to lock in that symbol. For example, the "wild" symbol has the highest lock in price ($50) because the wild symbol in that position is the most advantageous to the player if locked in out of all of the symbols. Since the upper right bell symbol has a relatively low lock in price ($1), locking in this symbol will have relatively little (if any) advantage to the player. Note that the same symbols may have different lock in prices because their respective positions are different. For example, the bell on the bottom left has a lock in price of $10, while the bell in the middle of the rightmost column has a lock in price of $1. This is because the bell in the bottom left is more advantageous to the player in this particular game example, based on the paytable used, reel configuration, etc.

Table I illustrates an example paytable. Of course this is just one example, and a myriad of other paytables can be used. Also, it is noted that the paytable and lock in surcharges illustrated in FIG. 2 are just non-mathematical examples selected to illustrate the concept. The symbols in a payline are compared to the paytable in order to determine if there is a winning combination on the payline, upon which the player wins an award designated by the paytable (and typically multiplied by the wager on that respective payline).

TABLE I

| |
|---|
| 5 wild = $10,000 |
| 5 suns = $2,000 |
| 5 telephones = $1,000 |
| 5 candles = $750 |
| 5 yin/yang = $500 |
| 5 smileys = $250 |
| 5 thumbs = $200 |
| 5 bells = $100 |
| 5 flags = $50 |
| 4 wild = $3,000 |
| 4 suns = $1,000 |
| 4 telephones = $400 |
| 4 candles = $250 |
| 4 yin/yang = $400 |
| 4 smileys = $350 |
| 4 thumbs = $100 |
| 4 bells = $50 |
| 4 flags = $10 |

Figure 3:
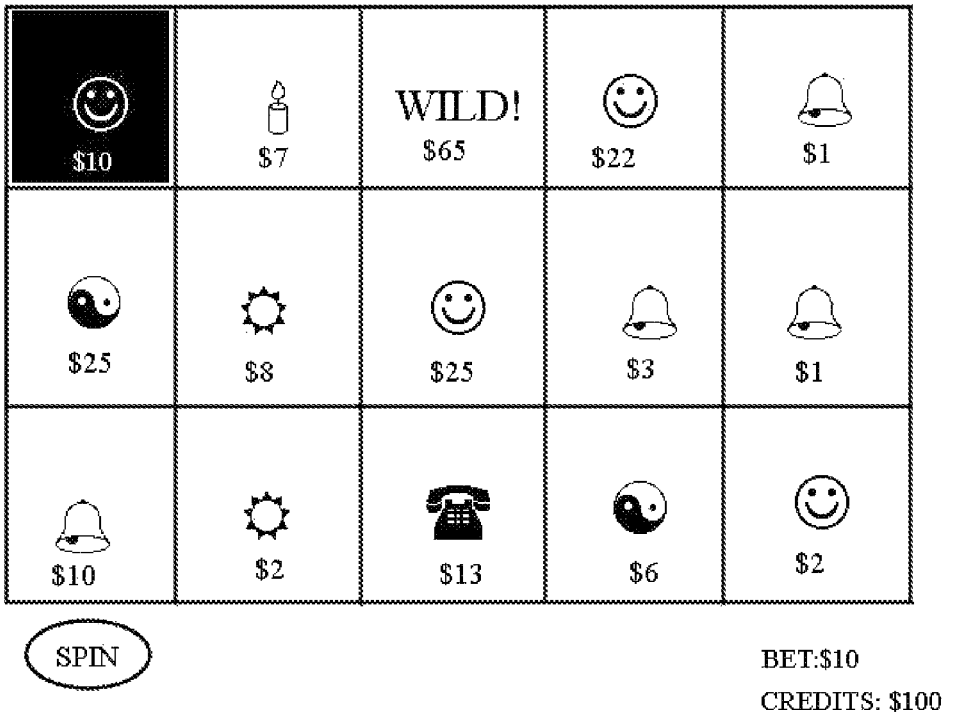
FIG. 3 is a drawing of the symbol combination illustrated in FIG. 2 with a particular symbol selected to be locked, according to an embodiment.

FIG. 3 is a drawing of the symbol combination illustrated in FIG. 2 with a particular symbol selected to be locked, according to an embodiment.

The player can select a symbol to lock in by touching one of the symbols on the grid (e.g., using a touch screen). For example, in FIG. 3 the player has selected the upper left "smiley face" symbol as the symbol to lock in. The slot machine can indicate to the player that a particular symbol is locked in, for example by highlighting the symbol, as shown in the upper left.

In an embodiment, more than one lock in symbol can be selected. Thus, in FIG. 3, after the player has selected the upper left symbol to lock in, the prices to lock in the remaining symbols have been updated to reflect that the upper left symbol has been locked in. The player can now select an additional symbol to lock in (by touching that symbol) or playing the game (by pressing spin). Pressing spin will deduct from the player's credit meter (which now reads $100) the cost for playing the game itself (e.g., $1 per line at 9 lines=$9) plus the surcharge for any locked in symbols (in this example, $10 for locking in the first symbol) equals $19.

Figure 4:
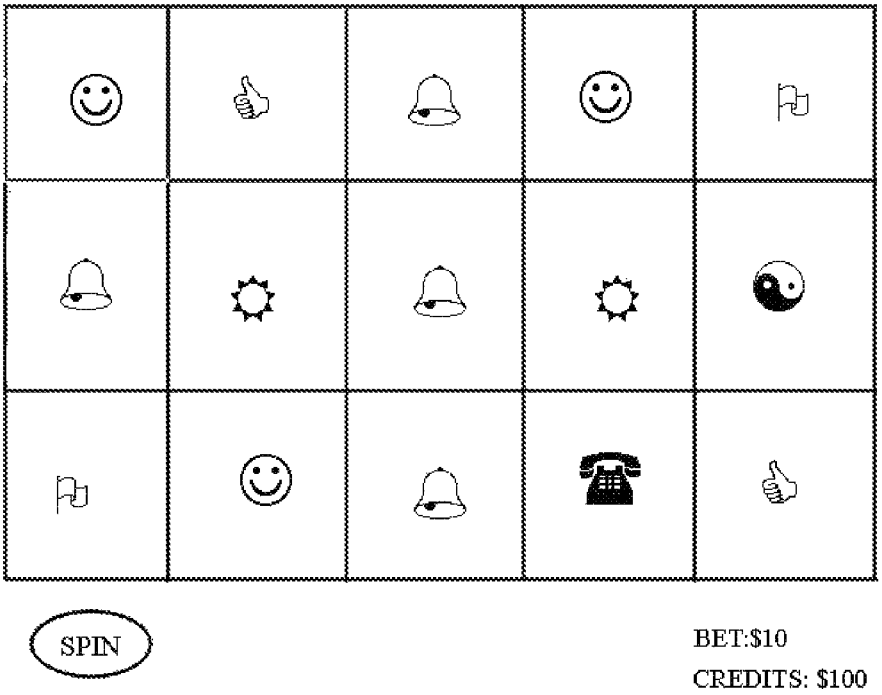
FIG. 4 is a drawing of the symbol combination illustrated in FIG. 3 after playing a new game with the selected symbol locked, according to an embodiment.

FIG. 4 is a drawing of the symbol combination illustrated in FIG. 3 after playing a new game with the selected symbol locked, according to an embodiment.

After the player presses spin in FIG. 3, the reels (or symbols) spin to a new random result, with the exception that any locked in symbol(s) (such as the smiley face in the upper left) do not change their symbol and remain. Thus, in FIG. 4, all the symbols but the upper left have been subject to a random spin and result. If a symbol in FIG. 4 remains the same from its location in FIG. 3 (aside from any locked in symbols such as the upper left symbol), this is just coincidental that the spin resulted in a same symbol in that respective position, but each occurrence is random (but for the locked in symbol which is fixed in place).

In an embodiment, the player can continue to purchase lock in symbols at this point. If the player wants the smiley in the upper left to be locked in again, he can select that symbol (for the lock in price). The player may also be able to select other symbols on the grid to lock in as well. Thus, if the player keeps playing a large number of games, the player may be able to generate a payline that almost has a winning combination (e.g., four like symbols in a row when five of the like symbols are needed). Of course, the lock in prices to lock in the almost winning combination would be very high since the fact that the player is close to winning a jackpot will be factored in. It may also be possible that the player can select a number of lock in symbols which already form a winning combination. If this is the case, the overall lock in price for all of these symbols would have to be higher than the payout for the already formed winning combination. Alternatively, if the player locks in a combination of symbols which already form a winning combination(s), this winning combination(s) will not be paid when the game is played again.

Note that the symbols in the same column as the locked in symbol (the upper left smiley face) are different from the symbols in these positions before the spin. For example, originally, below the locked in smiley face is a yin/yang symbol and below that, a bell (see FIG. 3). After the spin, below the locked in smiley face is now a bell and below that, a flag (see FIG. 4). This can be accomplished in two ways. In a first way, each symbol on each position in the grid is an independently spinning symbol (spins on its own reel). In a second way, each column is a reel which spins, however, after the spin is complete any locked in symbol(s) are then superimposed over whatever symbol would be displayed in each lock in symbol(s) respective position. For example, the first reel can spin to a random result, then regardless of what the upper left symbol would be, the smiley face symbol is then displayed over such symbol.

Typically, the player would have to wait until a symbol appears in a position after a game before the player can lock such symbol(s) in. For example, if the player wants to lock in a wild symbol, the player would have to keep playing the game until a wild symbol occurs, and then the player can lock that wild symbol in place (in the same position on the grid where it appeared when the last game ended).

Figure 5:
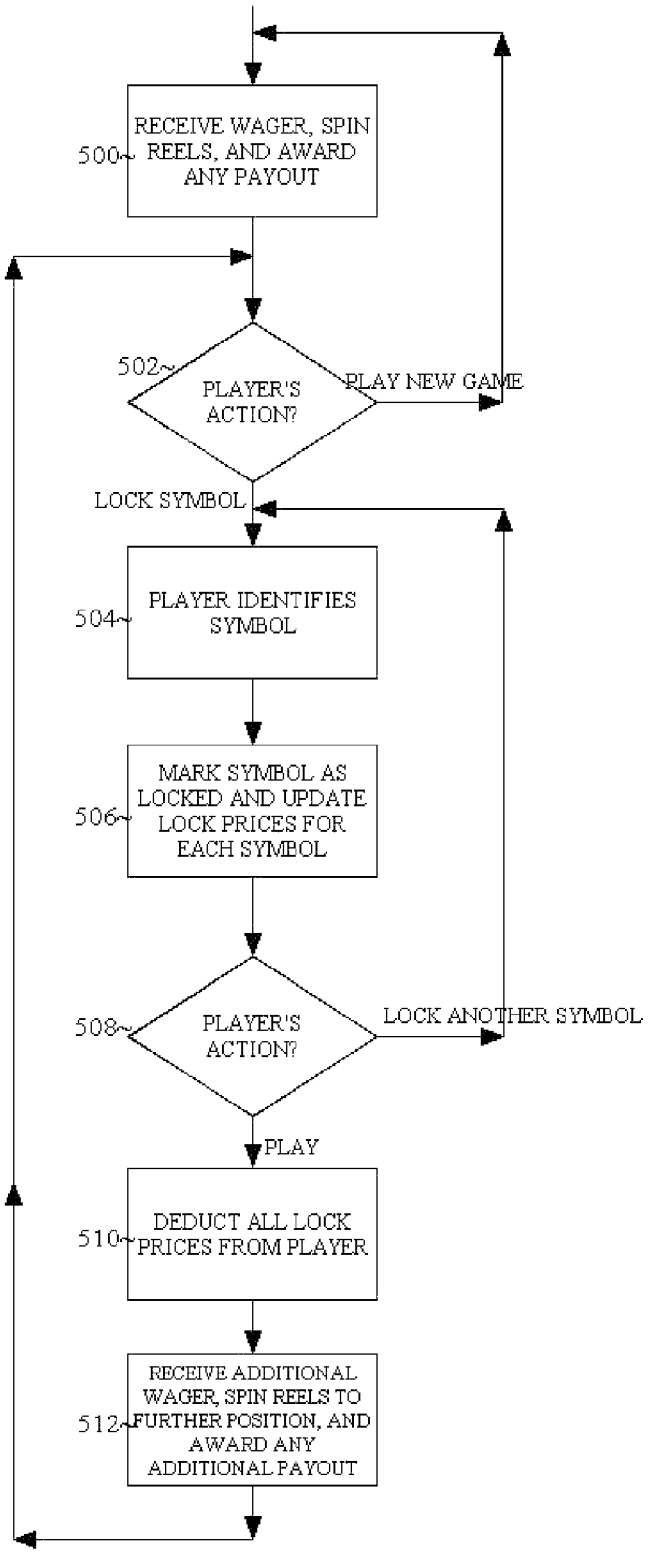
FIG. 5 is a flowchart illustrating an exemplary method of implementing a symbol lock, according to an embodiment.

FIG. 5 is a flowchart illustrating an exemplary method of implementing a symbol lock, according to an embodiment.

The method can begin with operation 500, which receives an initial player's wager, spins the reels to a first random result, and then awards a payout (if any) to the player based on the initial player's wager and the first random result of the reels. During this operation, all symbols (or reels) are spun, that is, none are locked in. At this point, lock in prices can also be displayed alongside each respective symbol so that the player knows the lock in cost for each symbol. This can correspond to FIG. 2.

From operation 500, the method can proceed to operation 502, wherein the player indicates his or her choice of action whether to begin an entirely new game (e.g., pressing a "spin button" upon which the method proceeds to operation 500), or the player wishes to "lock in a symbol." The player can indicate his or her choice on the gaming machine, such as by using a touch screen, pressing buttons, etc.

If, from operation 502, the player indicates his or her desire to lock in a symbol, then the method proceeds to operation 504, wherein the player identifies the symbol that the player wishes to lock in. The player can do this, for example, by touching the symbol that the player wishes to lock in.

Operations 502 and 504 can be combined, for example, if the player touches a particular symbol on the grid, then this is considered an indication of the player's choice of action as well as the player's indicated lock in symbol. If the player, instead of touching a symbol, presses the spin button, then the method can return to operation 500 as described in operation 502.

From operation 504, the method can proceed to operation 506, wherein the touched symbol would then typically be highlighted in some manner in order to indicate that symbol's status as a locked in symbol. See FIG. 3. If the embodiment being implemented allows more than one symbol to be locked in, then the lock in prices for the remaining symbols (except for the symbol already being locked in) are displayed to the player. See FIG. 3.

If the player touches a symbol that is already locked in, then in one embodiment, nothing would happen. In the player touches a symbol that is already locked in, then in another embodiment, the locked in symbol would then change its status to a not-locked in symbol. The symbol would lose its highlighting, and then the player would not be charged the lock in price for that symbol. Lock in prices for all other symbols can also be adjusted to reflect that this touched symbol is no longer locked in. In this way, the player can experiment with different combinations of locked in symbols on the grid, and view their prices to lock in, before finally deciding to spin and paying the locked in cost for all of the chosen locked in symbols.

From operation 506, the method can proceed to operation 508, which determines the player's action. The player can indicate to the machine that he or she wishes to lock in another symbol (e.g., by pressing another symbol) wherein the method would then return to operation 506. The player can also indicate to the machine that he or she wishes to lock in another symbol by pressing a "lock" button (not pictured), wherein the method would return to operation 504 so that the player can identify which particular symbol the player wishes to lock in.

If the player in operation 508 indicates to the machine that he or she wishes to now play the slot game (e.g., by pressing a "spin" button), the method can proceed to operation 510 which deducts all lock in prices from the player's credit meter.

From operation 510, the method can proceed to operation 512, which receives an additional wager from the player (the standard wager to play the slot game comprising individual wagers on respective paylines), spins the reels of the machine (but not changing any locked in symbols) to a further position of the reels. An additional payout is then computed based on the additional wager and the further position (by comparing symbols in positions defined by the active paylines bet on to a paytable) and if there is an additional payout, it is awarded to the player. See FIG. 4. Any money received from the player is deducted from the player's credit meter, and any money awarded to the player would be added to the player's credit meter.

From operation 512, the method can return to operation 502, which allows the player to choose to either begin a brand new game by returning to operation 500 (without locking any symbols), or choosing to proceed to operation 504 to lock in symbols before spinning again.

The prices associated with buying a lock in symbol should be computed based on the type of symbol (e.g., 7, cherry, etc.), its location (position) on the grid, whether there are any other active lock in symbol(s), and other characteristics of the current game being played (e.g., the paytable, current active paylines, current amount bet, reel configurations, etc.) The price for a lock in symbol should be based on the value to the player of locking in that symbol. For example, locking in the smiley face symbol in the upper left symbol on the grid (see FIG. 3) could be worth $10 to the player. In other words, with this symbol locked in, spinning the reels (which includes placing a separate wager) based on the current amount bet on respective paylines could result in an extra average win of $10 than if the game was played under the same conditions when the lock in symbol was not locked in. The extra average win does not have to exactly match the lock in price. For example, the lock in price can be slightly more than (e.g., 5%) the expected average additional win for locking in the particular symbol, thus providing the house a 5% profit on each symbol purchased by the player as a lock in symbol.

Thus, for example, if a player plays a slot game under the following conditions: bets $1 each on 9 lines for a total of $9, with an expected overall payout of $8 (e.g., a loss of $1). The player now wishes to lock in a particular symbol which has a lock in price of $1. Assuming the lock in price exactly matches the additional win for locking in that symbol, then with the lock in symbol purchased, the player will win (get a payout of) an average of $9 (e.g., a loss of $1 since the player pays $9 to spin plus the $1 lock in price). Typically, the decision whether to lock in a symbol or not would not involve skill, although in another embodiment a configuration can be implemented where particular symbols and/or combinations may return more or less than others (thus making the decision of which symbol(s) to lock in a skill decision).

Figure 6:
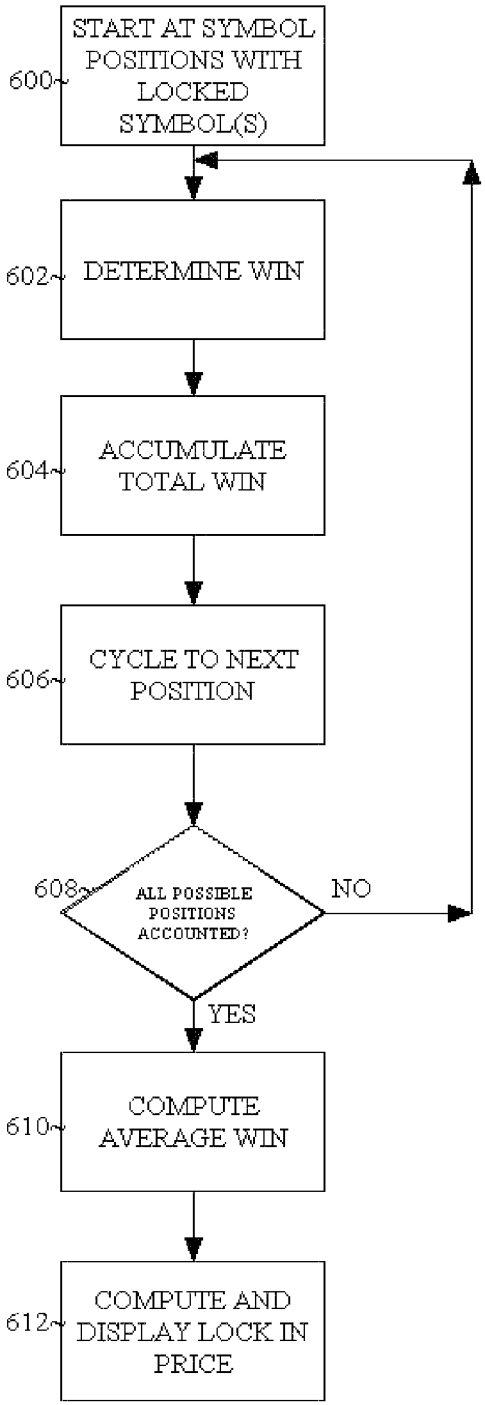
FIG. 6 is a flowchart illustrating an exemplary method of computing a symbol lock cost, according to an embodiment.

FIG. 6 is a flowchart illustrating an exemplary method of computing a symbol lock cost, according to an embodiment.

The method can begin with operation 600, which starts at a particular set of symbol positions with the chosen locked symbols in position. A total win is initialized to zero.

From operation 600, the method proceeds to operation 602, which determines a win (payout) for the current symbol positions. This is done by comparing symbols in positions on active paylines to a predetermined paytable in order to determine how much a payout to the player would be for the current combination of symbols in their respective positions. Each winning combination is multiplied by a wager on the respective payline.

From operation 602, the method proceeds to operation 604, which accumulates a total win by adding the win computed in operation 602 to the total accumulated win.

From operation 604, the method proceeds to operation 606, which cycles the reels or symbols to a next position. It is noted that the cycling is done "constructively," that is, the symbols do not have to be physically cycled or displayed on the machine, it is all performed using an algorithm (typically transparent to the player).

The next position is a next symbol position (which does not change any locked in symbols) so that eventually all symbol positions are analyzed in operation 602. The next symbol position can be computed in numerous ways (for example, trying all reel stops in a particular position, then restarting that position over again while incrementing another reel position, and so on.) For example, see Table II. If reels are used instead of individually spinning symbols, then the reel position is incremented which affects all positions in the column, but all lock in symbol(s) will be considered to be in their respective locked in position.

From operation 606, the method can proceed to operation 608, which determines whether all possible positions (considering that some symbols are locked in and do not change) have been accounted for (computed in operation 602 and factored in at operation 604). If all possible positions have not been accounted for, then the method can return to operation 602. If all possible positions have been accounted for (noting then that the last performance of operation 606 is not relevant), the method proceeds to operation 610.

In operation 610, an average win is computed. This can be done by taking the total win (accumulated in operation 604) and dividing it by the number of symbol positions possible (e.g., considered in operations 604 and 606). This is the average win (payout) the player will receive with the locked in symbol (a "lock in average win"). The average payout can of course also be computed using any other method as well.

From operation 610, the method can proceed to operation 612, which computes and displays the lock in price based on the average win determined in operation 610. For example, the lock in price can be the difference between the lock in average win and the game's overall average win (based on the player's current wagers/payline). Thus, for example, if the lock in average win is $20 and the game's overall average win is $10 (if no symbols were locked in), then the lock in price can be $10 (since the player is effectively getting an additional $10 in expected payouts by locking in the symbol). The game may also factor in a house advantage to the lock in price in order that the game actually profits from the player purchasing the lock in symbol. For example, the game can add a pre-determined percentage (e.g., 5%) to the computed lock in price. For example, if the lock in price as computed above is $10, then the game can add 5%, to result in a lock in price of $10.50 (thus the machine makes an expected $0.50 on the locked in symbol transaction). The final price is displayed to the player so the player can decide whether to actually purchase the particular symbol in question as a lock in symbol or not.

For example, consider a three reel, one horizontal line game, each reel having reel stops of symbols (cherry, 7, blank). Assume a simple paytable of: cherry/cherry/cherry pays $2 and 7/7/7 pays $5, on a $1 bet for one line. Assume the player locks in the first reel as a cherry. The first position analyzed can be (cherry, cherry, cherry). Assume equal probabilities of symbols landing at each position (no weighting). Without locking in any symbols, the expected payout for this game is $0.78 ($7 in total payouts/9 possible combinations). Table II below shows one example of possible positions cycled through to determine payouts of each position.

TABLE II

| # | first symbol | second symbol | third symbol | payout |
|---|---|---|---|---|
| 1 | cherry | cherry | cherry | $2 |
| 2 | cherry | cherry | 7 | |
| 3 | cherry | cherry | blank | |
| 4 | cherry | 7 | cherry | |
| 5 | cherry | 7 | 7 | |
| 6 | cherry | 7 | blank | |
| 7 | cherry | blank | cherry | |
| 8 | cherry | blank | 7 | |
| 9 | cherry | blank | blank | |

Based on the analysis, with cherry locked in, the lock in average win (payout) is $2. Thus, since the expected win of the main game is $0.78, the price to lock in the cherry in the first position (assuming the lock in price has no house advantage factored in) would be $2-0.78=$1.22.

As an alternative way to view paying for the lock in symbol, the player could pay $2 for the ability to lock in the cherry symbol and spin the reels to play the game. Thus, prices for lock in symbols could alternatively (as opposed to the above methodology which do not include the price to play the game) can pay for playing the game as well. The game may take out a house advantage from the price so that the house can make an expected profit. For example, with the expected win with the first cherry locked in at $2, then the house may wish to add 5% to this amount, thus costing the player a one time wager of $2.10 to play the game with the first cherry as a locked in symbol.

As an alternative to using the method illustrated in FIG. 6 to determine lock in prices, other methods can be used as well. For example, a table (or other data structure) of predetermined lock in prices can be maintained by the machine. The machine can compare the current game situation (the current symbols in each position and the lock in symbol(s) selected by the player) to a respective entry in the data structure in order to retrieve the respective lock in price.

In a further embodiment, a lock in price can be a fixed charge (e.g., $5) regardless of which symbol the player wishes to lock in. The fixed lock in price can be applicable to any spin or to a max-bet spin (all paylines at max coins). While the fixed lock in price does not take into account the current game situation, it is simpler and easier for the player to understand.

In a further embodiment, a player can position a symbol wherever the player chooses on the grid (e.g., by using a touch-screen), before a spin. The symbol can be a symbol of the player's choosing (e.g., a wild or other symbol), or a symbol that has appeared on the grid after the spin. The price for positioning such a symbol can be determined as described herein, such as described in FIG. 6 and the respective description. Thus, for example, if the player wants to purchase and position a wild symbol before the spin, the price to position or lock in this wild symbol would depend on the actual position (e.g., to place it in the left-most middle symbol would typically be higher than the right-most top symbol, since typically the left-most middle symbol is used in more paylines).

Figure 7:
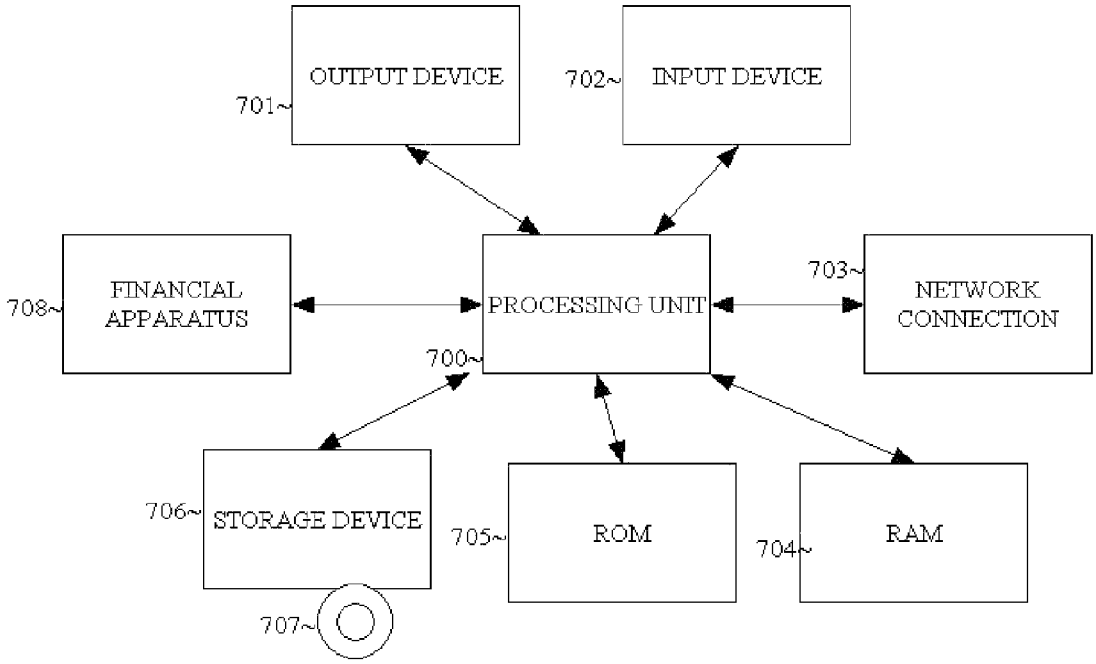
FIG. 7 is a block diagram illustrating one example of hardware that can be used to implement the methods described herein, according to an embodiment.

FIG. 7 is a block diagram illustrating one example of hardware that can be used to implement the methods described herein, according to an embodiment.

A processing unit 700 can be a microprocessor and any associated apparatus (e.g., cache, etc.) The processing unit 700 is connected to an output device 701, which can be any output device, such as a touch screen monitor, LCD, CRT, etc. The output device 701 can display results of the processing unit 700, such as the reels spinning and their initial outcome and final outcome, awards won, any outputs described herein or known in the art, etc. The processing unit 700 is also connected to an input device 702, which can be any input device such as a touch screen monitor, keyboard, mouse, buttons, etc. The processing unit 700 can also be connected to a network connection 703 which can connect to the Internet, an LAN, WAN, or any computer communications network. The processing unit 700 can also be connected to a RAM 704 and a ROM 705. The processing unit 700 can also be connected to a storage device 706 which can also read a computer readable storage medium 707 such as a CD or DVD. The computer readable storage medium 707 can store a program (and other assets such as media files) which can control a computer to implement any of the methods described herein. The processing unit 700 can also be connected to a financial apparatus 708 which can be used to accept payments from the player (e.g., a bill collector which receives cash from the player and converts it into player credits), a coin dispenser (which pays winnings to the players in the form of coins), etc.

Any type of slot machine game can be used with the methods described herein, including video slot machines or mechanical, finite or random, etc. Players can wager for real cash and get paid in real cash or tokens which can be exchanged for cash in a casino. All of the methods described herein can be effectuated in any order, and any operation not necessary for the operation of the method may be optional.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a slot machine game, the method comprising:

receiving an initial wager at an electronic gaming machine that comprises a processing unit, an input device, an output device, a dispenser, and a financial apparatus;

determining, by the processing unit, symbols randomly for displaying a first result in a grid;

displaying, by the output device, the first result in the grid, wherein the grid comprises multiple symbol positions including at least a first symbol position and a second symbol position at different locations in the grid, and wherein displaying the first result includes displaying a symbol at each respective symbol position in the grid;

paying, via the dispenser, any award earned on the initial wager based on the first result;

receiving, by the input device, a user-selection of a first symbol, displayed at the first symbol position for the first result, to be a first lock-in symbol maintained within the grid as part of a second result in the grid, and a user-selection of the second symbol position at which the first symbol will be displayed as the first lock-in symbol maintained within the grid as part of the second result;

receiving, at the financial apparatus, a second wager and a lock-in price based on positioning the first lock-in symbol at the second symbol position;

determining, by the processing unit, symbols randomly for displaying the second result in the grid, but maintaining the first lock-in symbol as part of the second result;

displaying, by the output device, the second result in the grid, wherein displaying the second result includes displaying the first lock-in symbol in the grid at the second symbol position and displaying the symbols randomly determined for displaying the second result in the grid at the other symbol positions in the grid; and paying, via the dispenser, any award earned on the second wager based on the second result, wherein a number of symbols displayed in the grid when the first result is displayed equals a number of symbols displayed in the grid when the second result is displayed.

2. The method as recited in claim 1, further comprising:

after determining symbols randomly for displaying the first result in the grid, displaying respective lock-in prices for symbols on the grid.

3. The method as recited in claim 1, further comprising:

after receiving the user-selection of the first symbol, displayed at the first symbol position for the first result, updating respective lock-in prices for symbols on the grid for another lock-in symbol, reflecting that the first lock-in symbol is already locked in.

4. The method as recited in claim 1, further comprising:

maintaining the first lock-in symbol as a lock-in symbol after determining symbols randomly for displaying the second result in the grid.

5. The method as recited in claim 1, wherein all symbols in the grid spin on their own independent reel.

6. The method as recited in claim 1, wherein the grid includes multiple columns, and wherein each column in the grid is an independently spinnable reel.

7. The method as recited in claim 1, further comprising:

prior to receiving, by the processing unit, the user-selection of the first symbol, displayed at the first symbol position for the first result, receiving, by the processing unit, a selection of a second symbol from the first result to change a status of the second symbol from a non-locked-in symbol status to a locked-in symbol status, displaying a lock-in price associated with the second symbol, and changing the status of the second symbol back to the non-locked-in symbol status.

8. The method as recited in claim 1, further comprising:

receiving, by the processing unit, a user-selection of a second symbol from the first result to be a second lock-in symbol, wherein the lock-in price accounts for respective lock-in prices associated with the first lock-in symbol and the second lock-in symbol.

9. The method of claim 1, further comprising:

determining, by the processing unit, that a combination of selected lock-in symbols formed a winning combination for the first result displayed in the grid and preventing payment of an award for that same winning combination appearing in the second result in the grid.

10. The method of claim 1, further comprising:

displaying a respective lock-in price at each symbol position in the grid while the grid displays the first result before the user-selection of the first symbol is received; and displaying a respective updated lock-in price at one or more symbol positions in the grid while the grid displays the first result after the user-selection of the first position and the user-selection of the second symbol position are received, wherein each updated lock-in price is greater than the lock-in price displayed at a respective symbol position while the grid displays the first result before the user-selection of the first symbol is received.

11. The method of claim 1, further comprising:

receiving, by the processing unit, a user-selection of a third symbol, displayed at a third symbol position in the grid for the first result, to be a second lock-in symbol to be maintained within the grid as part of the second result in the grid, wherein displaying the second result in the grid further includes displaying the second lock-in symbol at the third symbol position.

12. The method of claim 1, wherein the financial apparatus accepts payments at least in the form of currency.

13. An electronic gaming machine to play a slot machine game, the electronic gaming machine comprising:

a financial apparatus;

a dispenser;

a processing unit;

an input device;

an output device; and a non-transitory computer-readable medium storing a computer-readable program, that when executed by the processing unit, cause a set of functions to be performed by the electronic gaming machine, the set of functions comprising:

receiving an initial wager;

determining symbols randomly for displaying a first result in a grid;

displaying, by the output device, the first result in the grid, wherein the grid comprises multiple symbol positions including at least a first symbol position and a second symbol position at different locations in the grid, and wherein displaying the first result includes displaying a symbol at each respective symbol position in the grid;

paying, via the dispenser, any award earned on the initial wager based on the first result;

receiving, by the input device, a user-selection of a first symbol, displayed at the first symbol position for the first result, to be a first lock-in symbol maintained within the grid as part of a second result in the grid, and a user-selection of the second symbol position at which the first symbol will be displayed as the first lock-in symbol maintained within the grid as part of the second result;

receiving, at the financial apparatus, a second wager and a lock-in price based on positioning the first lock-in symbol at the second symbol position;

determining symbols randomly for displaying the second result in the grid, but maintaining the first lock-in symbol as part of the second result;

displaying, by the output device, the second result in the grid, wherein displaying the second result includes displaying the first lock-in symbol in the grid at the second symbol position and displaying the symbols randomly determined for displaying the second result in the grid at the other symbol positions in the grid; and paying, via the dispenser, any award earned on the second wager based on the second result; and wherein a number of symbols displayed in the grid when the first result is displayed equals a number of symbols displayed in the grid when the second result is displayed.

14. The electronic gaming machine as recited in claim 13, wherein the set of functions further comprises, after determining symbols randomly for displaying the first result in the grid, providing lock-in prices to the output device for displaying respective lock-in prices for the symbols on the grid.

15. The electronic gaming machine as recited in claim 13, wherein the set of functions further comprises, after receiving the user-selection of the first symbol, displayed at the first symbol position for the first result, updating respective lock-in prices for symbols on the grid reflecting that the first lock-in symbol is already locked in.

16. The electronic gaming machine as recited in claim 13, wherein the set of functions further comprises maintaining the first lock-in symbol as a lock-in symbol after determining symbols randomly for displaying the second result in the grid.

17. The electronic gaming machine as recited in claim 13, wherein all symbols in the grid spin on their own independent reel.

18. The electronic gaming machine as recited in claim 13, wherein the grid includes multiple columns, and wherein each column in the grid is an independently spinnable reel.

19. The method as recited in claim 6, wherein the first lock-in symbol is at a particular position within a particular column of the grid, and wherein displaying the second result in the grid includes superimposing the first lock-in symbol over another symbol on a reel, that includes the first lock-in symbol and the other symbol, when the other symbol is positioned at the particular position within the particular column of the grid after that reel stops spinning.

20. The electronic gaming machine of claim 13, wherein the processing unit is configured to receive a user-selection of a third symbol, displayed at a third symbol position in the grid for the first result, to be a second lock-in symbol to be maintained within the grid as part of the second result in the grid, wherein displaying the second result in the grid further includes displaying the second lock-in symbol at the third symbol position.

21. The electronic gaming machine of claim 13, wherein determining symbols randomly for displaying the second result in the grid includes determining a symbol for each symbol position of the multiple symbol positions except any symbol position at which a lock-in symbol was selected to be displayed for the second result.

22. The electronic gaming machine of claim 13, wherein the financial apparatus accepts payments at least in the form of currency, and wherein the dispenser provides payments at least in the form of coins.

* * * * *